US007699012B2

(12) United States Patent
Cotten

(10) Patent No.: US 7,699,012 B2
(45) Date of Patent: Apr. 20, 2010

(54) APPARATUS FOR PLUGGING A SEACOCK EXTERNALLY

(76) Inventor: Gregory Benedict Cotten, 929 Olive Ave., Coronado, CA (US) 92118

( * ) Notice: Subject to any disclaimer, the term of this patent is extended or adjusted under 35 U.S.C. 154(b) by 0 days.

(21) Appl. No.: 11/926,035

(22) Filed: Oct. 28, 2007

(65) Prior Publication Data

US 2009/0107383 A1 Apr. 30, 2009

(51) Int. Cl.
*B63B 13/00* (2006.01)

(52) U.S. Cl. ..... 114/197; 114/227

(58) Field of Classification Search ..... 114/197, 114/227; 220/234–236
See application file for complete search history.

(56) References Cited

U.S. PATENT DOCUMENTS 1,068,793 A * 7/1913 Mason ..... 220/236
2,978,138 A * 4/1961 Moeller ..... 220/235
3,295,712 A * 1/1967 Peterson ..... 220/235
3,812,810 A * 5/1974 Moeller ..... 114/197
4,930,657 A * 6/1990 Walker ..... 220/235
5,184,698 A * 2/1993 Coffenberry ..... 184/1.5

* cited by examiner

*Primary Examiner*—Ed Swinehart

(57) ABSTRACT

This invention is directed to an irregular in shape thru-hull fitting with specifically an internal seacock which is below the normal waterline of a marine vessel and this invention provides an exterior plug to stop leakage and/or allow for maintenance of the interior hull valve, piping, and/or associated tubing without necessitating the need to haul out the vessel. The seacock plug includes a flexible tubing assembly; o-ring flange assembly, flexible beveled gasket, and compression lead screw with T-handle that forms a watertight seal around the irregular interior shape hull fitting.

1 Claim, 5 Drawing Sheets

PERSPECTIVE SEACOCK PLUG UNASSEMBLED

FIGURE 1 - MARINE VESSEL SEACOCK
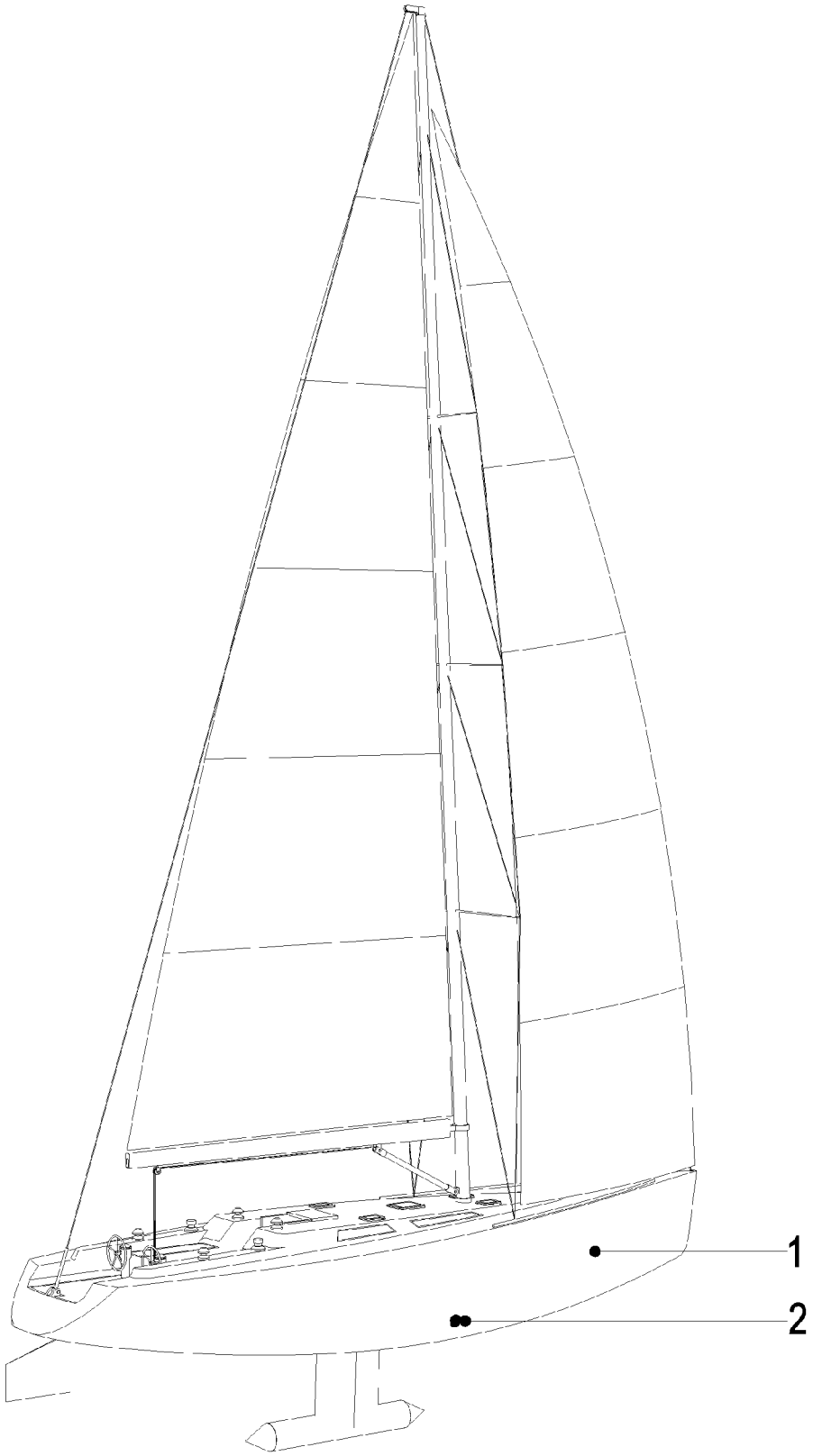

FIGURE 2 - SEACOCK ISOMETRIC
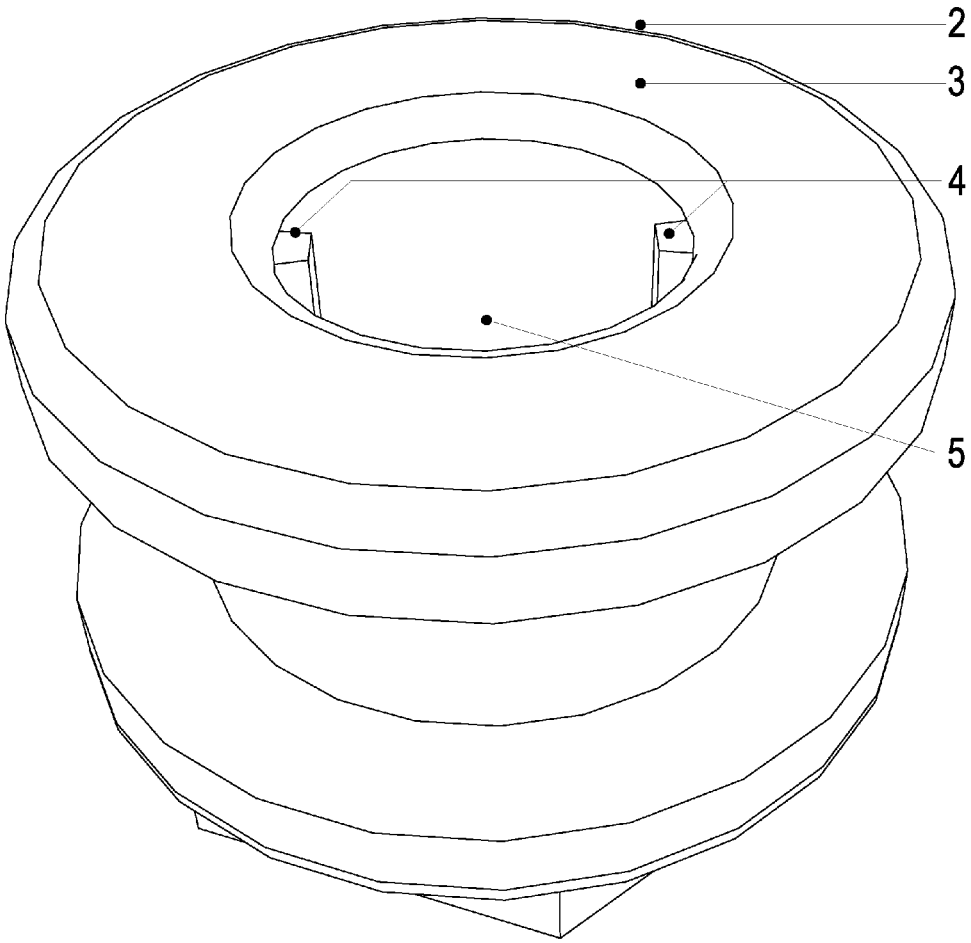

FIGURE 3 - PERSPECTIVE SEACOCK PLUG UNASSEMBLED
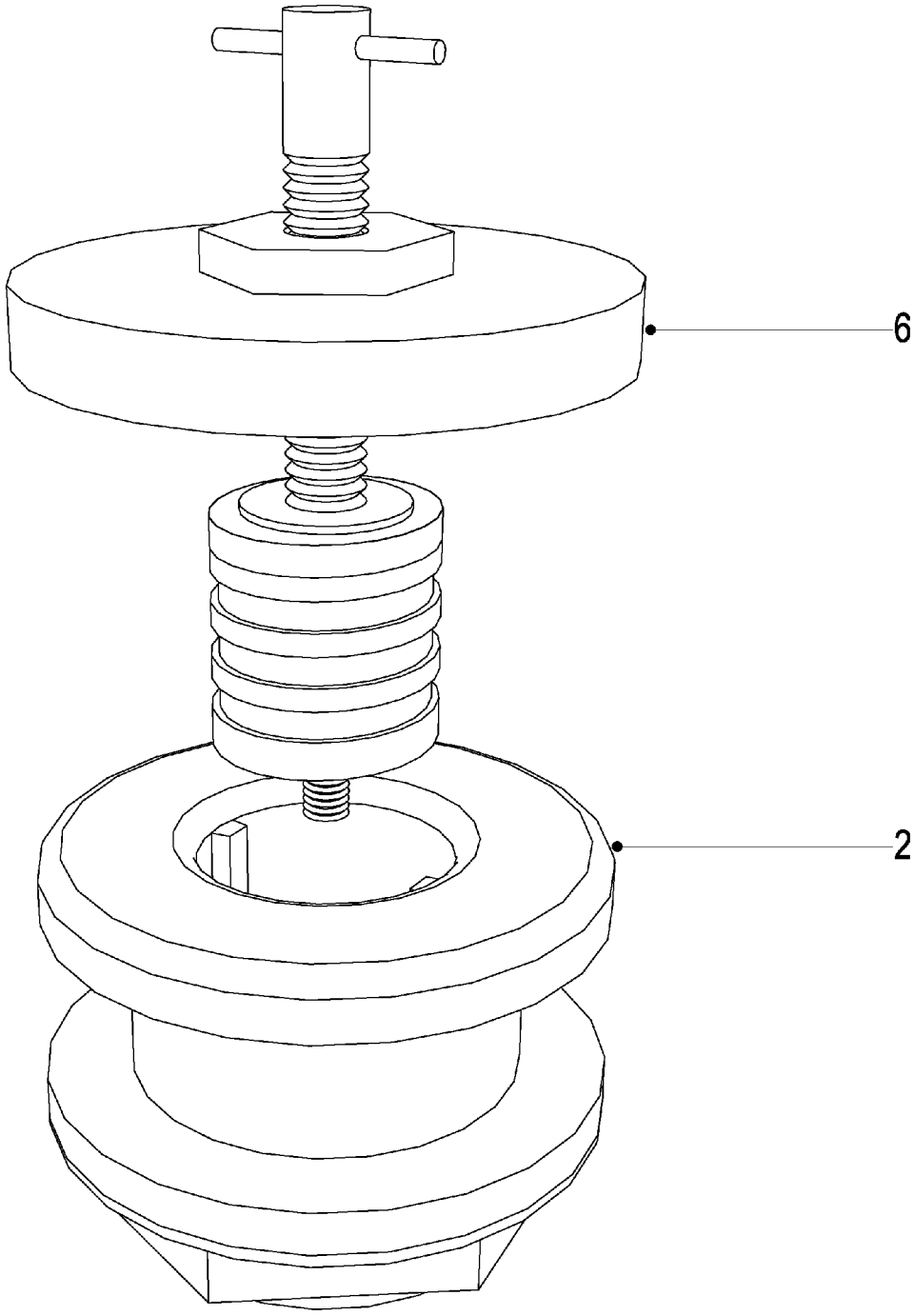

FIGURE 4 - SEACOCK PLUG UNASSEMBLED
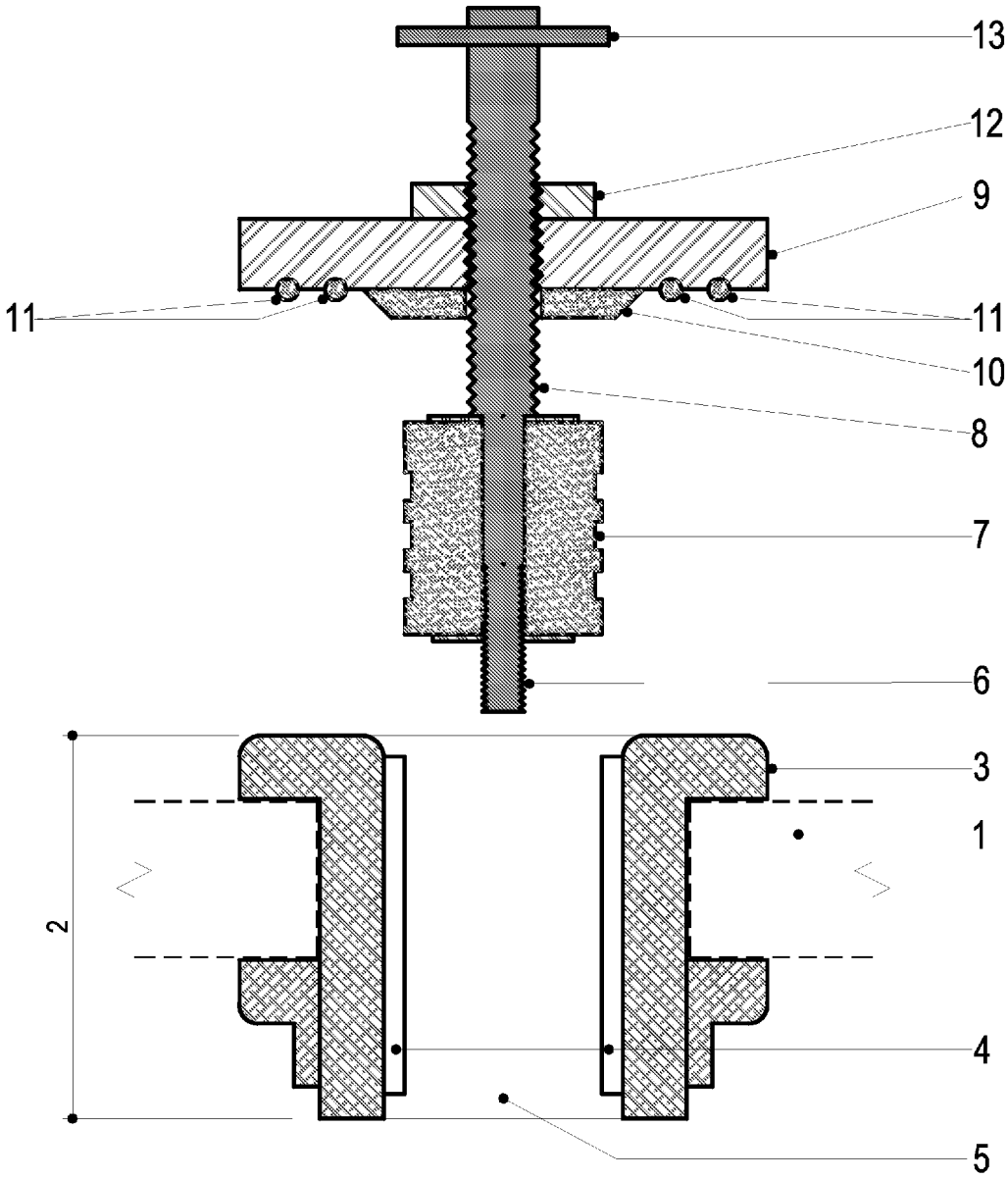

FIGURE 5 - SEACOCK PLUG ASSEMBLED
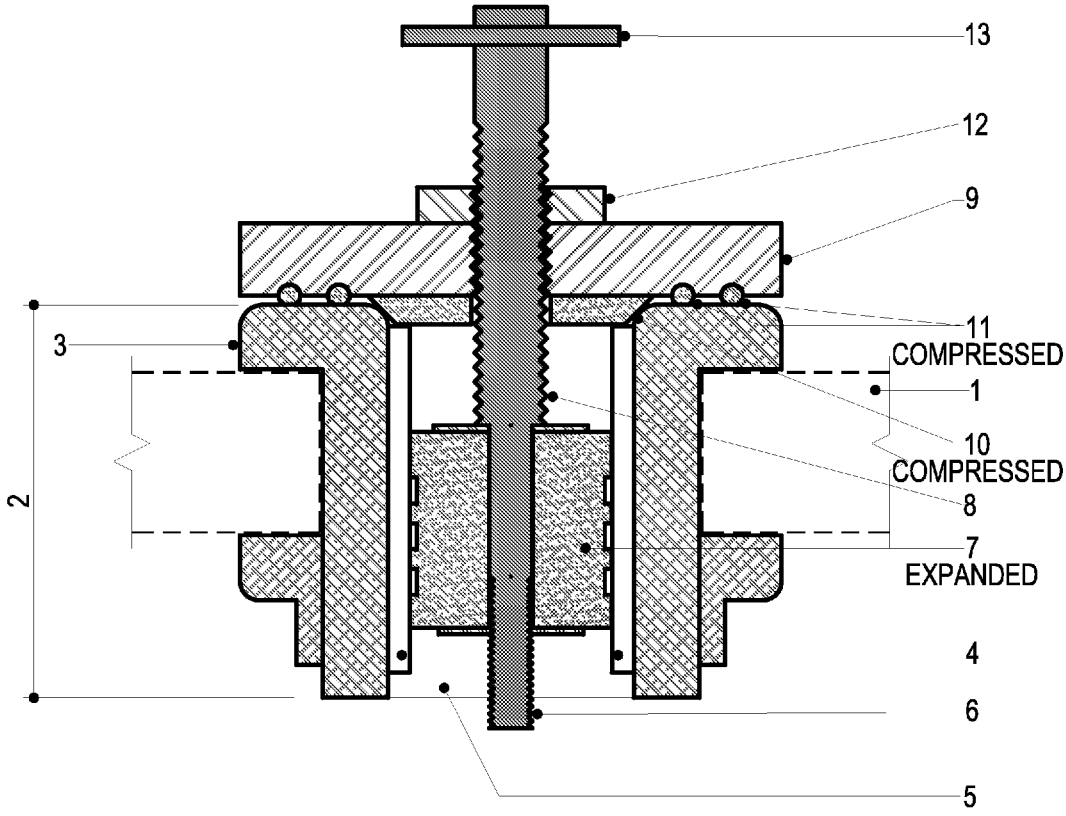

APPARATUS FOR PLUGGING A SEACOCK EXTERNALLY

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention, a marine vessel thru hull seacock plug, applies to irregular in shape thru-hull fittings connected to a hull valve, commonly called a seacock, which is below the normal waterline of a marine vessel. These thru hull fittings are formed typically with at least two internal ridges used for assembly that make them unsuitable for the application of a circular plug as shown in FIG. 2. The present invention prevents water intrusion by the application of an externally-applied (water-side) plug device which allows for the water-borne removal of the seacock or the emergency stoppage of flooding in the specific case of seacock failure.

Related art is replete with the solution to plugging a perfectly round hole consisting primarily of circular plugs. These plugs can be applied either internally or externally as the thru-hull is not equipped with an internal isolation valve, commonly called a seacock, for their intended above waterline use. Examples of circular plugs are taught in U.S. Pat. Nos. 6,390,007; 5,184,698; 4,930,657; 3,812,810; 3,295,712; 2,978,138; and 1,446,812 while a screw-type permanent plug is taught in U.S. Pat. No. 4,512,547. Non-plugging, but protective caps are taught in U.S. Pat. No. 7,210,423. None of these are suitable for the plugging of an irregular hole as this present invention addresses.

Marine vessels have below water line penetrations, called thru hulls that allow for the flow of seawater (or fresh water for inland use) from outside of the hull to the inside of the hull. These fittings normally have an isolation valve on the inside of the vessel, commonly called a seacock, and then are connected to various types of pipes and/or hoses to direct water for myriad uses such as engine cooling and head flushing. The thru hull external fitting is circular in nature but typically has two 180° apart and raised sections (called fins in this work) that allow for a special tool to hold the fixture secure while assembling the complete device, typically with a threaded nut on the interior of the hull. These raised sections or fins make the hole unsuitable for normal round plugs because these two fins prevent the smooth and continuous formation of a watertight seal.

The round hull drain plugs are ubiquitous in the marine industry and provide a smooth circular flexible tubing, typically rubber, gasket material that works well with correspondingly smooth circular thru hull fittings. These do not work in typical below waterline thru hull/seacock fittings and as such maintenance of the internal valves, piping and associated hoses require the haul out of marine vessels to a dry dock or other such out of water configuration. This haul out is costly and can only be accomplished at special facilities for vessels that are not normally transported on trailers. In addition, the failure of a seacock could lead to loss of the vessel if the flooding could not be stopped. This invention would typically apply to power boats of greater than 10 meters in length and nearly all fixed-keel sailboats.

BRIEF SUMMARY OF THE INVENTION

The seacock external plug of the present invention provides for the ability to plug a thru-hull opening from the external or waterside of the fitting to allow for maintenance of the internal valves, piping and/or hoses while maintaining the marine vessel water-borne and in addition provides for a quick and easy way to isolate flooding should the seacock fail. The present invention does not modify or improve prior art for their intended purpose, however, similar attributes of the circular drain plug system as taught in U.S. Pat. No. 6,390,007 and its referenced prior art are used as a basis for one aspect of this invention suitable modified to incorporate the external flange which provides for the water tight integrity not available with a common circular plug.

BRIEF DESCRIPTION OF SEVERAL VIEWS OF THE DRAWINGS

The figures shown depict only exemplary configurations that may be employed for the present invention. Those skilled in the art will recognize variations to the figures presented herein. The features and advantages of the present invention will become apparent from the following detailed description of the invention when read with the accompanying drawings in which:

FIG. 1 is a typical marine vessel, in this case a sailboat, showing a thru hull.

FIG. 2 is an isometric view of a thru hull external fitting.

FIG. 3 is an isometric perspective view of this invention, the seacock plug, in proximity of the thru hull and prior to installation.

FIG. 4 is a detailed view of this invention, the seacock plug, uninstalled.

FIG. 5 is a detailed view of this invention, the seacock plug, fully installed.

DETAILED DESCRIPTION OF THE INVENTION

With reference to the figures, exemplary embodiments of the invention will now be described. Before proceeding to a detailed description of the preferred embodiments of the present invention and alternate embodiments, several general comments should be made about the applicability and the scope of the present invention. The scope of the invention disclosed is applicable to a plurality of uses, such as but not limited to other devices where a plug is required for an irregular shaped inner area of a hole. Thus even though embodiments are described specifically to marine vessel hulls, the present invention is applicable to other uses or applications.

As illustrated in FIG. 1, the present invention 6 (not shown in FIG. 1) is usually installed below the waterline on the thru hull 2 located on the hull 1 of a marine vessel. As further illustrated in FIG. 2, the thru hull 2 is shown in isometric view where the outer flange 3 surrounds the inner passage or hole 5, which is irregular in shape due to the raised pins 4 (two shown 180° apart) which fit to a special assembly tool when the thru hull is installed through the hull of the vessel.

As illustrated in FIG. 3, this invention 6 is designed to be inserted into thru hull 2.

As illustrated in FIG. 4, this invention 6 is composed of a central threaded shaft 8, a flexible tubing assembly 7 of which is capable of axial compression and associated radial expansion, a flexible beveled gasket 10 sealed to an external flange 9 with two concentric o-rings 11 partially embedded and sealed in a semi-circular groove machined into the interior side of flange 9, a locking nut 12 and a T-handle 13. As further illustrated in FIG. 4, this invention 6 is shown at the point of initial insertion into the thru hull 2 external flange 3 with the limiting fins 4 being the first point of contact between this invention 6 and the thru hull 2. The thru hull 2 is shown installed flush on hull 1.

As illustrated in FIG. 5, this invention 6 is shown installed on thru hull 2 with the flexible tubing assembly 7 expanded and providing compressive holding power onto fins 4 of the internal circumference of thru hull 2. The T-handle 13 being turned clockwise causes the threaded shaft 8 to compress the flexible tubing assembly 7 and thusly cause its diameter to increase. The ribbed nature of the flexible tubing assembly 7 ensures good friction between itself 7 and the fins 4 of the thru hull 2. After securely fixing the flexible tubing assembly 7, the external flange 9 is turned clockwise along the threaded stem 8 until the flexible beveled gasket 10 and two o-rings 11 form a seal against the thru hull outer flange 3. The flexible beveled gasket 10 is compressed into the flange fillet of thru hull 2 outer flange 3 and the 2 concentric o-rings 11 are compressed onto the thru hull 2 outer flange 3. The locking nut 12 is then turned clockwise until firmly against the exterior flange 9 to ensure the seal is maintained. As illustrated in FIG. 5, the combination of three sealing surfaces, namely the flexible beveled gasket 10 to the flange fillet of thru hull 2 flange 3 and the 2 o-rings 11 to the flange 3 of the thru hull 2 ensure a watertight seal. As further illustrated in FIG. 5 this invention 6 is capable of plugging an irregular hole by the gap left between the flexible tubing assembly 7 and the thru hull 2 flange 3 due to the irregular shape of the thru hull 2 fins 4.

The invention claimed is:

1. A marine vessel thru hull seacock plug comprising in combination:

a. a flexible tubing assembly that expands and mechanically binds to an irregular shaped thru hull fitting which has raised fins thus making the hole irregular b. an external flange with a dual continuous o-rings and a flexible beveled gasket connected to the flexible tubing assembly c. the flexible tubing assembly and external flange being connected together through a male-threaded rod d. the external flange having female threads which allow it to move along the male-threaded rod connecting it to the flexible tubing assembly e. the external flange making a watertight seal to the hull of a vessel when its dual o-rings and flexible gasket are compressed through rotation of the external flange along the threaded rod f. a locking nut which attaches to the male-threaded rod and holds the external flange securely in place.

* * * * *